US005983981A

United States Patent [19]

Spink

[11] Patent Number: 5,983,981

[45] Date of Patent: Nov. 16, 1999

[54] CASTING STEEL STRIP

[75] Inventor: John Spink, Shellharbour, Australia

[73] Assignees: Ishikawajima-Harima Heavy Industries Company Ltd., Tokyo, Japan; BHP Steel (JLA) Pty. Ltd., Melbourne, Australia

[21] Appl. No.: 09/095,051

[22] Filed: Jun. 10, 1998

[30] Foreign Application Priority Data

Jun. 13, 1997 [AU] Australia ..... PO7323

[51] Int. Cl.[6] ..... B22D 11/06; B22D 41/50

[52] U.S. Cl. ..... 164/480; 164/428; 164/437; 222/606

[58] Field of Search ..... 164/437, 337, 164/428, 480, 488; 222/606, 607

[56] References Cited

U.S. PATENT DOCUMENTS 5,701,948 12/1997 Strezov et al. ..... 164/428

*Primary Examiner*—Kuang Y. Lin

*Attorney, Agent, or Firm*—Kerkam, Stowell Kondracki & Clarke, P.C.; John C. Kerins

[57] ABSTRACT

Continuous casting of steel strip by solidification of casting poo (68) onto chilled cooling rolls (16) of a twin roll caster. Steel is delivered to casting pool (68) by a refractory delivery nozzle (19) which dips into the casting pool. The refractory material of nozzle (19) contains a significant quantity of chemical compounds contains sulphur, such as molybdenum disulphide ($MoS_2$), magnesium sulphide (MgS) and calcium sulphate ($CaSO_4$).

27 Claims, 4 Drawing Sheets

CASTING STEEL STRIP

BACKGROUND OF THE INVENTION

This invention relates to the casting of steel strip.

It is known to cast metal strip by continuous casting in a twin roll caster. In this technique molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

Although twin roll casting has been applied with some success to non-ferrous metals which solidify rapidly on cooling, there have been problems in applying the technique to the casting of ferrous metals. One particular problem encountered in the casting of aluminium killed steel in a twin roll strip caster is the propensity for molten steel to produce solid inclusions, in particular inclusions which contain aluminates. Such inclusions can affect the surface quality of the strip as well as having the tendency to block any small casting passages in the metal delivery system. This has led to the use of manganese/silicon killed steels as an alternative, such as described in our New Zealand Patent Application 270147. However, such silicon/manganese killed steels have a significantly higher oxygen content than aluminium killed steels and this gives rise to problems in casters in which the delivery nozzle formed of refractory material containing carbon dips into the casting pool, the pool being disturbed by carbon monoxide bubbles generated by reactions between carbon in the submerged delivery nozzle and oxygen containing compounds in the molten metal of the casting pool. Such disturbance leads to the formation of discrete waves in the casting pool which are reflected in the cast strip as depressions in the strip surface. These defects are commonly referred to as meniscus marks. Moreover, carbon leaching from the refractory material of the metal delivery nozzle is enhanced.

Silicon/manganese killed steels will have an oxygen content in the range of 50–155 ppm at typical casting temperatures of the order of 1600–1700° C. whereas the oxygen content of aluminium killed steels will generally be less than 10 ppm and the carbon leaching problem is a very significant one when endeavouring to cast silicon/manganese killed steel.

Our International Patent Application PCT/AU96/00244 describes a proposal to address this problem by the controlled addition of sulphur to the silicon/manganese killed steel melt at least in the start-up phase of a casting operation. However, the controlled addition of sulphur to the steel adds complexity to the process and results in the production of steel with high sulphur content which may not generally be acceptable to all markets. By the present invention the problem is addressed by modifying the chemical composition of the refractory material of the delivery nozzle rather than that of the steel melt.

SUMMARY OF THE INVENTION

According to the invention there is provided method of continuously casting steel strip of the kind in which molten metal is introduced into the nip between a pair of parallel casting rolls via a submerged metal delivery nozzle to create a casting pool of molten metal supported on casting surfaces of the roll immediately above the nip and the casting rolls are rotated to deliver a solidified steel strip downwardly from the nip, wherein the lower part of the delivery nozzle dips into the casting pool and the delivery nozzle is comprised of a refractory material containing carbon and a significant quantity of one or more chemical compounds containing sulphur.

The invention also provides apparatus for casting metal strip, comprising a pair of parallel casting rolls forming a nip between them, an elongate delivery nozzle disposed above and extending along the nip between the casting rolls for delivery of molten metal into the nip to form a casting pool of molten metal supported on casting surfaces of the rolls above the nip, and means to rotate the rolls to produce a solidified strip passing downwardly from the nip, wherein the delivery nozzle is formed of a refractory material containing carbon and a significant quantity of one or more chemical compounds containing sulphur.

Preferably the or each of said chemical compounds does not disassociate at temperatures below 1100° C.

The or each of said compounds may be a metal sulphide or metal sulphate. More specifically the refractory material of the nozzle may contain a significant quantity of molybolenum disulphide ($MoS_2$), magnesium sulphide (MgS), or calcium sulphate ($CaSO_4$) or a combination of two or more of those compounds.

In particular the refractory material may contain 0.25 to 1 percent by weight of $MoS_2$. Alternatively it may contain 0.5 to 2 percent by weight of $CaSO_4$ or MgS.

The refractory material of the nozzle may be comprised mainly of alumina graphite. Typically it may comprise about 58% $Al_2O_3$, 32% carbon and 5% $ZrO_2$.

The invention also extends to a refractory nozzle for delivery of molten metal to a twin roll strip caster, comprising a refractory body defining an open topped trough to receive molten metal and metal delivery passages for flow of metal from the bottom of the trough out of the nozzle, wherein the refractory body is made of a refractory material containing carbon and a significant quantity of one or more chemical compounds containing sulphur.

BRIEF DESCRIPTION OF THE DRAWINGS

In order that the invention may be more fully explained one particular method and apparatus will be described in some detail with reference to the accompanying drawings in which.

DESCRIPTION OF PREFERRED EMBODIMENT

Figure 1:
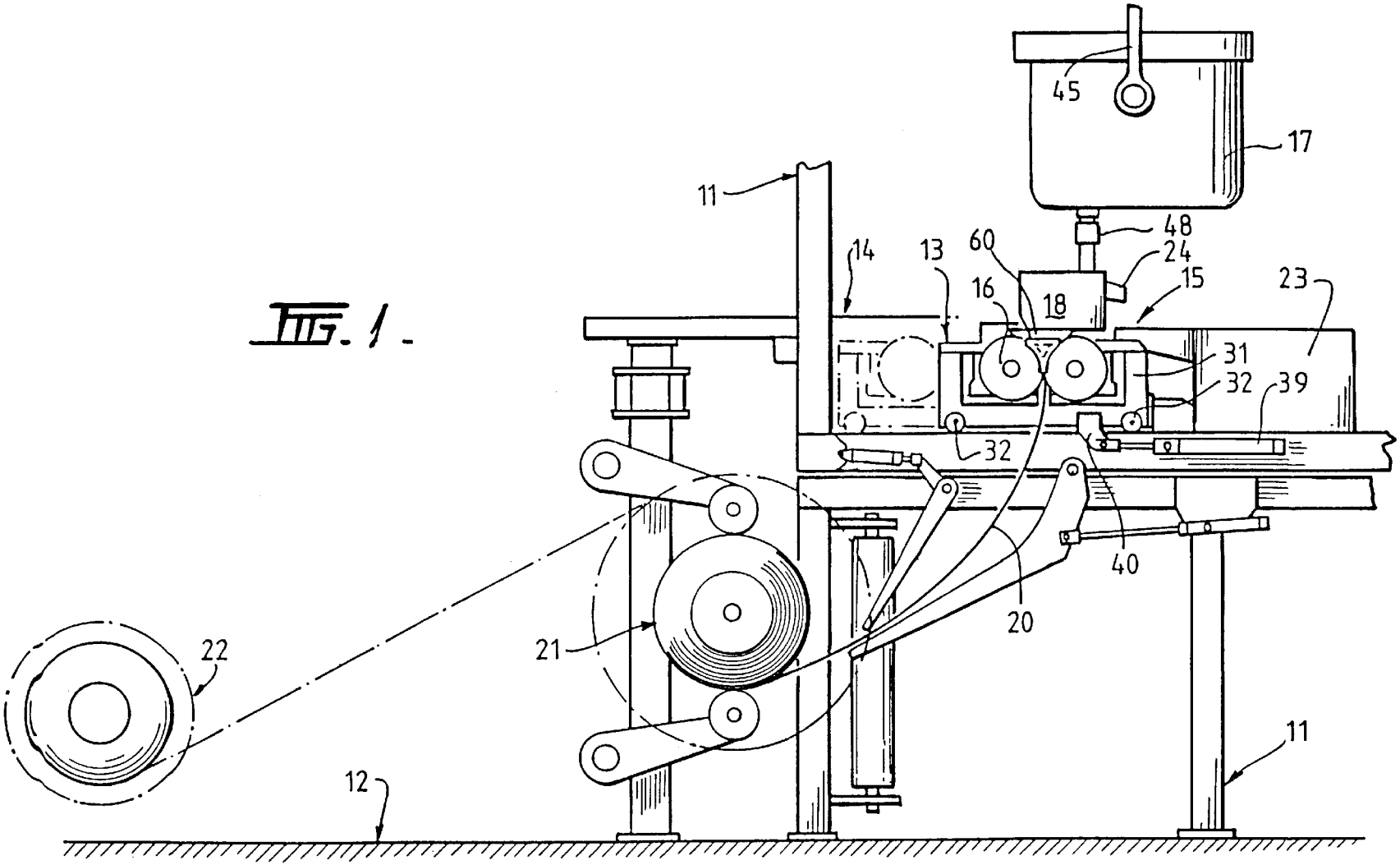
FIG. 1 illustrates a twin roll continuous strip caster constructed and operating in accordance with the present invention.
Figure 2:
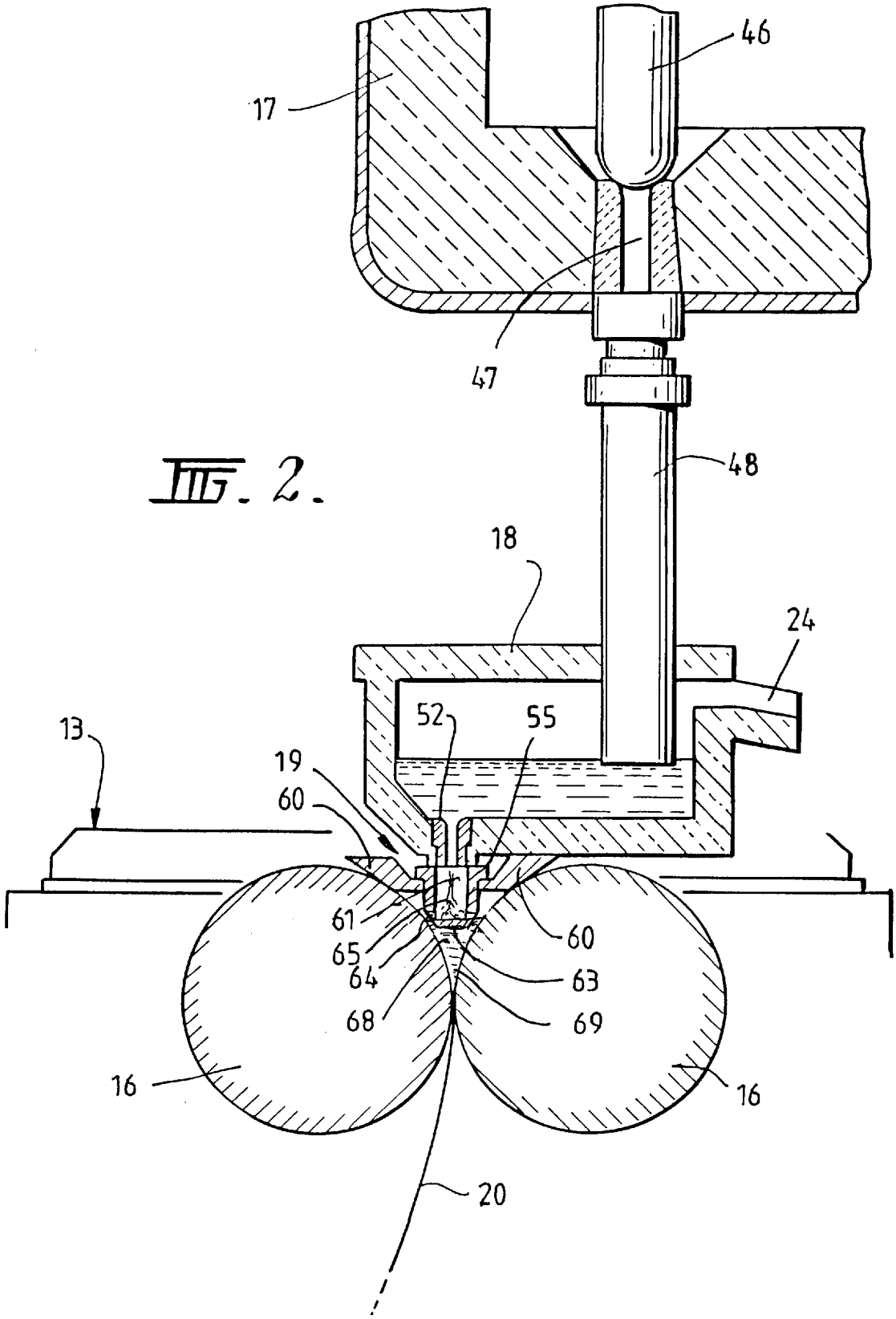
FIG. 2 is a vertical cross-section through important components of the caster illustrated in FIG. 1 including a metal delivery nozzle constructed in accordance with the invention.
Figure 3:
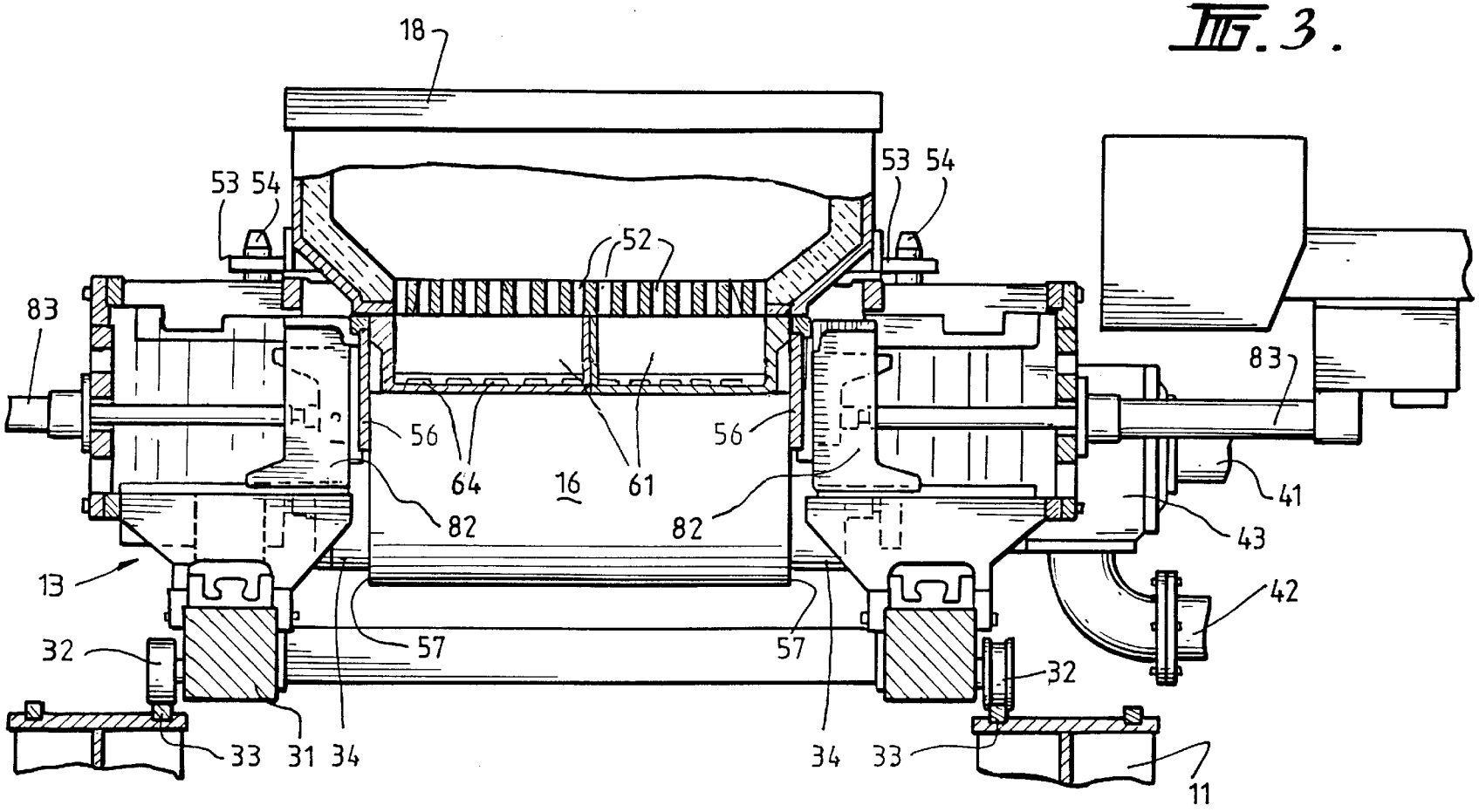
FIG. 3 is a further vertical cross-section through important components of the caster taken transverse to the section of FIG. 2.

The illustrated caster comprises a main machine frame 11 which stands up from the factory floor 12. Frame 11 supports a casting roll carriage 13 which is horizontally moveable between an assembly station 14 and a casting station 15. Carriage 13 carries a pair of parallel casting rolls 16 to which molten metal is supplied during a casting operation from a ladle 17 via a distributor 18 and delivery nozzle 19. Casting rolls 16 are water cooled so that shells solidify on the moving roll surfaces and are brought together at the nip between them to produce a solidified strip product 20 at the nip outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Carriage 13 is moveable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra-rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 2 m long in order to produce up to 2 m wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is formed as a wide dish made of a refractory material such as high alumina castable with a sacrificial lining. One side of the distributor receives molten metal from the ladle and is provided with the aforesaid overflow 24. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as accurately to locate the distributor.

Figure 4:
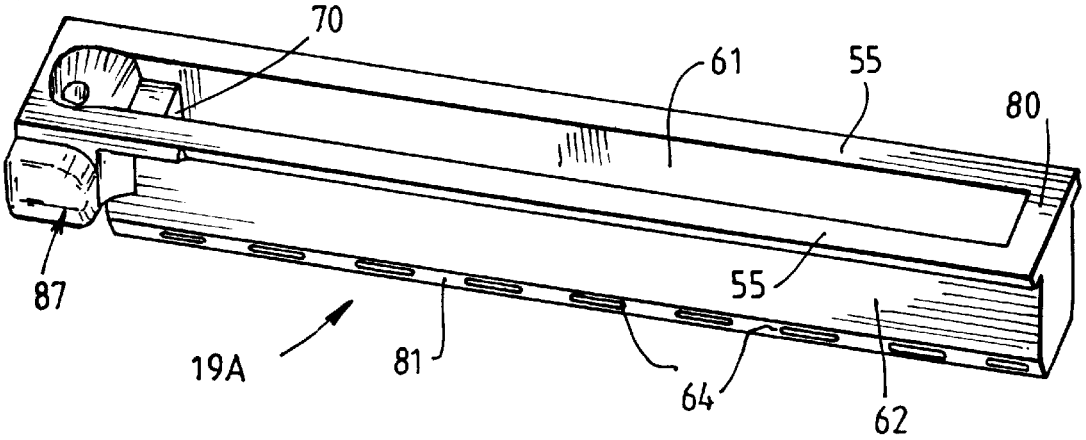
FIG. 4 is a perspective view of the delivery nozzle segment.
Figure 5:
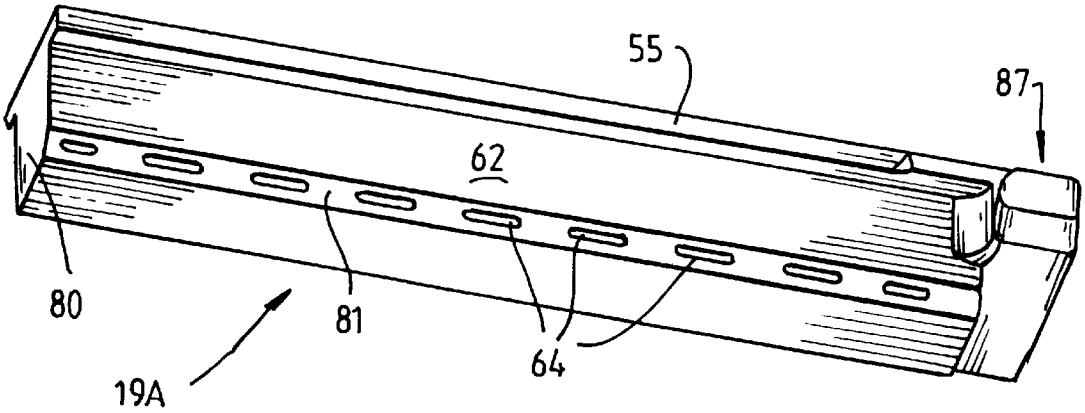
FIG. 5 is an inverted perspective view of the nozzle segment.

Delivery nozzle 19 is formed in two identical half segments which are made of alumina graphite refractory material and are held end to end to form the complete nozzle. FIGS. 4 and 5 illustrate the construction of the nozzle segments 19A which are supported on the roll carriage frame by a mounting bracket 60, the upper parts of the nozzle segments being formed with outwardly projecting side flanges 55 which locate on that mounting bracket.

Each nozzle half segment is of generally trough formation so that the nozzle 19 defines an upwardly opening inlet trough 61 to receive molten metal flowing downwardly from the openings 52 of the distributor. Trough 61 is formed between nozzle side walls 62 and end walls 70 and may be considered to be transversely partitioned between its ends by the two flat end walls 80 of the nozzle segments which are brought together in the completed nozzle. The bottom of the trough is closed by a horizontal bottom floor 63 which meets the trough side walls 62 at chamfered bottom corners 81. The nozzle is provided at these bottom corners with a series of side openings in the form of longitudinally spaced elongate slots 64 arranged at regular longitudinal spacing along the nozzle. Slots 64 are positioned to provide for egress of molten metal from the trough generally at the level of the trough floor 63.

The outer ends of the nozzle segments are provided with end formations denoted generally as 87 extending outwardly beyond the nozzle end wall 70 and provided with metal flow passages to direct separate flows of molten metal to the "triple point" regions of the pool ie those regions of the pool where the two rolls and the side dam plates come together. The purpose of directing hot metal to those regions is to prevent the formation of "skulls" due to premature solidification of metal in these regions.

Molten metal falls from the outlet openings 52 of the distributor in a series of free-falling vertical streams 65 into the bottom part of the nozzle trough 61. Molten metal flows from this reservoir out through the side openings 64 to form a casting pool 68 supported above the nip 69 between the casting rolls 16. The casting pool is confined at the ends of rolls 16 by a pair of side closure plates 56 which are held against the ends 57 of the rolls. Side closure plates 56 are made of strong refractory material, for example boron nitride. They are mounted in plate holders 82 which are moveable by actuation of a pair of hydraulic cylinder unites 83 to bring the side plates into engagement with the ends of the casting rolls to form end closures for the casting pool of molten metal.

In the casting operation the flow of metal is controlled to maintain the casting pool at a level such that the lower end of the delivery nozzle 19 is submerged in the casting pool and the two series of horizontally spaced side openings 64 of the delivery nozzle are disposed immediately beneath the surface of the casting pool. The molten metal flows through the openings 64 in two laterally outwardly directed jet streams in the general vicinity of the casting pool surface so as to impinge on the cooling surfaces of the rolls in the immediate vicinity of the pool surface. This maximises the temperature of the molten metal delivered to the meniscus regions of the pool and it has been found that this significantly reduces the formation of cracks and meniscus marks on the melting strip surface.

The illustrated apparatus can be operated to establish a casting pool which rises to a level above the bottom of the delivery nozzle so that the casting pool surface is above the floor of the nozzle trough and at about the same level as the metal within the trough. Under these conditions it is possible to obtain stable pool conditions and if the outlet slots are angled downwardly to a sufficient degree it is possible to obtain a quiescent pool surface.

Metal delivery nozzle 19 is made primarily of alumina graphite. Typically it may comprise of the order of 58% $Al_2O_3$, 32% carbon and 5% zirconium dioxide $ZrO_2$. In accordance with the present invention the refractory material of the nozzle also contains a significant quantity of a chemical compound containing sulphur. More specifically it may contain 0.25 to 1 percent by weight of $MoS_2$. Alternatively it may contain 0.5 to 2 percent by weight of $CaSO_4$ or MgS. Without the inclusion of such sulphur-containing compounds in the refractory material it has been found that the high oxygen content of the silicon/manganese killed steel causes leaching of carbon from the refractory materials to produce carbon monoxide bubbles in the casting pool which leads to meniscus marks. More particularly, ferrous oxide or other oxides in the slag react with carbon to produce carbon monoxide and iron or other metals respectively. The presence of sulphur within the refractory material substantially eliminates this problem.

A number of mechanisms have been proposed, one of which is that sulphur is strongly surface active and reacts with iron in the melt to form ferrous sulphide in preference to the formation of ferrous oxide. This reaction produces oxygen which remains dissolved in the steel and cannot readily react with carbon in the refractory material. Moreover it has been found that the inclusion of compounds containing sulphur in the refractory material alters the wetting characteristics of the nozzle. Specifically the wettability of the nozzle by the steel melt is very much reduced which reduces the exposure of the carbon in the refractory to the oxygen containing compounds in the steel melt.

The refractory delivery nozzle segments may be formed by cold isostatic pressing the selected refractory formulation in powder form and then firing the pressed body at a temperature of the order of 1000° C. in a reducing atmosphere, for example in an oven containing coke or in a sealed canister. With this production process it is not possible to use free sulphur in the refractory since it would sublime at the firing temperature, nor is it possible to use compounds which might disassociate at temperatures below 1100° C. It is preferred to use $MoS_2$, $CaSO_4$ or MgS since these compounds remain stable and do not disassociate at temperatures below 1100° C. The preferred proportions of these compounds as specified above are chosen to provide sufficient sulphur to inhibit the reaction between oxygen in the melt and carbon in the refractory material without significantly detracting from the strength and refractory qualities of the resulting material.

I claim:

1. A method of continuously casting steel strip comprising:

introducing molten metal between a pair of chilled casting rolls via an elongate metal delivery nozzle disposed above and extending along the nip between the rolls to form a casting pool of molten metal supported above the nip and confined at the ends of the nip by pool confining end closures, and rotating the rolls so as to cast a solidified strip delivered downwardly from the nip; wherein the lower part of the delivery nozzle dips into the casting pool and the delivery nozzle comprises a refractory material containing carbon, and a significant quantity of at least one chemical compound containing sulphur.

2. A method as claimed in claim 1, wherein said at least one chemical compound is one which does not dissociate at temperatures below about 1100° C.

3. A method as claimed in claim 1, wherein said at least one chemical compound is selected from the group consisting of a metal sulphide and a metal sulphate.

4. A method as claimed in claim 3, wherein the refractory material of the nozzle contains a significant quantity of a chemical compound selected from the group consisting of molybdenum disulphide ($MoS_2$), magnesium sulphide (MgS), calcium sulphate ($CaSo_4$), and a combination of at least two of said compounds.

5. A method as claimed in claim 4, wherein the refractory material contains 0.25 to 1 percent by weight of $MoS_2$.

6. A method as claimed in claim 4, wherein the refractory material contains about 0.5 to about 2 percent by weight of a compound selected from the group consisting of $CaSO_4$ and MgS.

7. A method as claimed in claim 4, wherein the refractory material of the nozzle is comprised mainly of alumina graphite.

8. A method as claimed in claim 7, wherein the refractory material comprises about 58% $Al_2O_3$, about 32% carbon, and about 5% $ZrO_2$.

9. Apparatus for casting metal strip, comprising a pair of parallel casting rolls forming a nip between them, an elongate delivery nozzle disposed above and extending along the nip between the casting rolls for delivery of molten metal into the nip to form a casting pool of molten metal supported on casting surfaces of the rolls above the nip, and means for rotating the rolls to produce a solidified strip passing downwardly from the nip, wherein the delivery nozzle is formed of a refractory material containing carbon and a significant quantity of at least one chemical compound containing sulphur.

10. Apparatus as claimed in claim 9, wherein said at least one chemical compound does not dissociate at temperatures below about 1100° C.

11. Apparatus as claimed in claim 9, wherein said at least one chemical compound is selected from the group consisting of a metal sulphide and a metal sulphate.

12. Apparatus as claimed in claim 11, wherein the refractory material of the nozzle contains a significant quantity of a chemical compound selected from the group consisting of molybdenum disulphide ($MoS_2$), magnesium sulphide (MgS), calcium sulphate ($CaSO_4$), and a combination of at least two of said compounds.

13. Apparatus as claimed in claim 12, wherein the refractory material contains 0.25 to 1 percent by weight of $MoS_2$.

14. Apparatus as claimed in claim 12, wherein the refractory material of the nozzle is comprised mainly of alumina graphite.

15. Apparatus as claimed in claim 14, wherein the refractory material comprises about 58% $Al_2O_3$, about 32% carbon and about 5% $ZrO_2$.

16. Apparatus as claim in claim 10, wherein said at least one chemical compound is selected from the group consisting of a metal sulphide and a metal sulphate.

17. Apparatus as claimed in claim 16, wherein the refractory material of the nozzle contains a significant quantity of a chemical compound selected from the group consisting of molybdenum disulphide ($MoS_2$), magnesium sulphide (MgS), calcium sulphate ($CaSO_4$), and a combination of at least two of said compounds.

18. A refractory nozzle for delivery of molten metal to a twin roll strip caster, comprising a refractory body defining an open topped trough to receive molten metal and metal delivery passages for flow of metal from the bottom of the trough out of the nozzle, wherein the refractory body is made of a refractory material containing carbon and a significant quantity of at least one chemical compound containing sulphur.

19. A refractory, nozzle as claimed in claim 18, wherein said at least one chemical compound does not dissociate at temperatures below about 1100° C.

20. A refractory nozzle as claimed in claim 18, wherein said at least one chemical compound is selected from the group consisting of a metal sulphide and a metal sulphate.

21. A refractory nozzle as claimed in claim 20, wherein the refractory material of the nozzle contains a significant quantity of a chemical compound selected from the group consisting of molybdenum disulphide ($MoS_2$), magnesium sulphide (MgS), calcium sulphate ($CaSO_4$), and a combination of at least two of said compounds.

22. A refractory nozzle as claimed in claim 21, wherein the refractory material contains 0.25 to 1 percent by weight of $MoS_2$.

23. A refractory nozzle as claimed in claim 21, wherein the refractory material contains about 0.5 to about 2 percent by weight of a compound selected from the group consisting $CaSO_4$ and MgS.

24. A refractory nozzle as claimed in claim 22, wherein the refractory material of the nozzle is comprised mainly of alumina graphite.

25. A refractory nozzle as claimed in claim 24, wherein the refractory material comprises about 58% $Al_2O_3$, about 32% carbon and about 5% $ZrO_2$.

26. A refractory nozzle as claimed in claim 19, wherein said at least one chemical compound is selected from the group consisting of a metal sulphide and a metal sulphate.

27. A refractory nozzle as claimed in claim 26, wherein the refractory material of the nozzle contains a significant quantity of a chemical compound selected from the group consisting of molybdenum disulphide ($MoS_2$), magnesium sulphide (MgS), calcium sulphate ($CaSO_4$), and a combination of at least two of said compounds.

* * * * *